United States Patent [19]

Eckert et al.

[11] 4,163,816

[45] Aug. 7, 1979

[54] NOVEL METHOD FOR FORMING SILVER DIFFUSION TRANSFER IMAGE RECEIVING LAYERS

[75] Inventors: Robert D. Eckert, Lexington; Boris Levy, Wayland; John B. Mahoney, Tewksbury, all of Mass.

[73] Assignee: Polaroid Corporation, Cambridge, Mass.

[21] Appl. No.: 846,157

[22] Filed: Oct. 27, 1977

[51] Int. Cl.[2] ..... B05D 1/34; B05D 1/36; B05D 3/10

[52] U.S. Cl. ..... 427/401; 427/415; 427/339

[58] Field of Search ..... 427/401, 415; 106/193 M, 194; 96/113, 29 R

[56] References Cited

U.S. PATENT DOCUMENTS

| | | | |
|---|---|---|---|
| 3,607,269 | 9/1971 | Young | 96/29 |
| 3,671,241 | 6/1972 | Land | 96/29 |
| 3,969,541 | 7/1976 | Mukaida et al. | 96/29 |
| 3,976,817 | 8/1976 | Mukaida et al. | 427/308 |

*Primary Examiner*—James R. Hoffman
*Attorney, Agent, or Firm*—Philip G. Kiely

[57] ABSTRACT

Silver diffusion transfer image-receiving elements are formed by hydrolyzing a solution of a hydrolyzable cellulose ester, coating a support with a layer of said hydrolyzed cellulose ester and disposing silver precipitating nuclei therein.

12 Claims, No Drawings

NOVEL METHOD FOR FORMING SILVER DIFFUSION TRANSFER IMAGE RECEIVING LAYERS

BACKGROUND OF THE INVENTION

U.S. Pat. No. 3,671,241 issued June 20, 1972 discloses and claims image-receiving elements which comprise an image-receiving stratum composed of a silver precipitating agent dispersed therein, the image-receiving stratum having been rendered "permeable" to an alkaline processing composition by suitable modification prior to photographic processing but after the silver precipitating agent has been incorporated. In the most useful embodiments, the image-receiving stratum comprises regenerated cellulose obtained by alkaline hydrolysis of a cellulose ester, e.g., cellulose diacetate, and containing a silver precipitating agent. As disclosed in said patent only a depthwise portion of the cellulose ester stratum need be hydrolyzed to regenerated cellulose. The transferred silver is precipitated within the regenerated cellulose stratum thus obtained, even though an additional depthwise portion of the cellulose ester may be hydrolyzed to cellulose during the diffusion transfer process and additional silver precipitating nuclei thus made available.

U.S. Pat. No. 3,607,269 issued Sept. 21, 1971 discloses and claims improvements in image-receiving elements of the type disclosed by U.S. Pat. No. 3,671,241 wherein various photographic reagents may be disposed initially in the stratum of unhydrolyzed polymer and extracted from the polymer during processing. The disposal of such reagents and subsequent extraction permits the utilization of compounds which are desirable during processing but which could be detrimental to the process if made available at the wrong time. This makes it possible to utilize a wide variety of photographically useful reagents and to control or meter the rate at which they become available to participate in the process. As with U.S. Pat. No. 3,671,241, the image-receiving elements are prepared by hydrolyzing a depthwise portion of the hydrolyzable polymer layer prior to photographic processing.

U.S. Pat. No. 3,969,541, issued July 13, 1976, is directed to a method for forming a diffusion transfer image-receiving sheet which comprises contacting a surface portion of an alkali impermeable polymer with a solution containing both silver precipitating nuclei and a material capable of hydrolyzing a portion of said polymer. This method simultaneously makes the surface portion of the polymer alkali permeable and incorporates silver precipitating nuclei therein.

U.S. Pat. No. 3,976,817, issued Aug. 24, 1976, is directed to a method for forming a diffusion transfer image-receiving sheet which comprises hydrolyzing the surface portions of an alkali-impermeable polymer and, subsequent to said hydrolysis, absorbing diffusion transfer nuclei into said surface portion from a solution or dispersion of the nuclei in a solvent selected from the group consisting of water, a ketone, an alcohol or a mixture of these solvents.

BRIEF DESCRIPTION OF THE INVENTION

The present invention is directed to a method for forming a silver diffusion transfer image-receiving element which comprises at least partially hydrolyzing a solution of a hydrolyzable cellulose ester under acidic conditions, coating a support with said hydrolyzed cellulose ester and disposing silver precipitating nuclei therein. The silver precipitating nuclei can be disposed in the acid hydrolyzed cellulose ester either before coating or after coating.

DETAILED DESCRIPTION OF THE INVENTION

It has now been found that an image-receiving layer for silver diffusion transfer processing comprising at least partially hydrolyzed cellulose ester containing silver precipitating nuclei therein can be prepared without surface hydrolysis of the cellulose ester layer. The aforementioned patents described methods of hydrolyzing a portion of an already-formed cellulose ester layer to render it alkali-diffusible and to incorporate silver precipitating nuclei therein. This hydrolysis step involves the application of a strong chemical, e.g., concentrated sodium hydroxide, to a surface, which could introduce an aspect of variability to the product as well as being a difficult operation.

By means of the present invention, the surface hydrolysis operation is eliminated and the cellulose ester is acid hydrolyzed in solution, prior to the formation of a layer, so that the degree of hydrolysis is easily measured and controlled. At the option of the operator, the nuclei may be incorporated into the hydrolyzed ester while in the solution phase or imbibed into the coated layer.

In the hydrolysis treatment described in the prior art, a hydrolysis gradient exists since a surface treatment is employed involving a depthwise reaction in a layer with a greater proportion of the ester groups hydrolyzed nearer the surface, with the least number of ester groups hydrolyzed the further from the surface to which the hydrolyzing agent is applied.

By means of the present invention, an image-receiving layer of more uniform composition is obtained since the hydrolysis takes place in solution before the layer is formed thereby providing for a more uniform contact of ester groups and hydrolyzing agent. In addition, the silver precipitating nuclei can be incorporated into the hydrolyzed cellulose ester either during the solution phase or after coating as a layer, thereby permitting deeper imbedment in the layer.

The image-receiving element of the present invention comprises a support carrying a layer which is substantially regenerated cellulose formed by acid hydrolysis with a relatively low ester content, e.g., less than 25% ester groups, and more preferably around 21% ester groups.

The image-receiving elements of the present invention may comprise other layers in addition to the acid hydrolyzed layer described above. In one embodiment, the image-receiving element includes a strip coat distal to the support which, during processing, would be intermediate the photosensitive element and the image-receiving layer. The strip coat functions in a conventional manner, i.e., providing for clean and easy separation of the photosensitive element and the image-receiving element. In addition, various stabilizing materials can be disposed in the strip coat such as the mercapto substituted compounds disclosed in U.S. Pat. No. 3,607,269, such as 3-mercapto-1,2,4-triazole.

In still another alternative embodiment of the present invention, the image-receiving element may include a layer of acid-reacting material to provide for neutralization of residual processing composition. In a preferred embodiment, the layer of acid-reacting material is located adjacent the support, i.e., intermediate the support and the image-receiving strata. The silver image stabilizing compound may be disposed in the layer of acid-reacting material.

As examples of suitable acid-reacting reagents, mention may be made of zinc sulfate, aluminum sulfate, boric acid and the esters thereof, as well as the polymeric acid materials set forth, for example, in U.S. Pat. No. 3,573,043.

A silver image stabilizing compound, such as the gold salts disclosed and claimed in copending application Ser. No. 731,674, filed Oct. 12, 1976, may be disposed in a plurality of the above-described layers. In a preferred embodiment, it is disposed in both the strip coat and in the layer containing the acid-reacting material. In the event there is a possibility of interaction between a given silver precipitating nuclei and silver image stabilizing compound, it is preferred that the silver image stabilizing compound be disposed in a layer other than the layer containing the silver precipitating nuclei.

Suitable cellulose esters for use in the novel process of the present invention include cellulose organic esters, such as cellulose acetates, preferably cellulose hydroacetate, cellulose diacetate, cellulose triacetate, or mixtures of these materials, cellulose propionate, cellulose butyrate, cellulose acetate butyrate, and the like.

Examples of suitable silver precipitating agents include heavy metals such as iron, lead, zinc, nickel, cadmium, tin, chromium, copper, cobalt, particularly noble metals such as gold, silver, platinum and palladium. Other useful silver precipitating agents include sulfides and selenides of heavy metals, and noble metals particularly sulfides of mercury, copper, aluminum, zinc, cadmium, cobalt, nickel, silver, lead, antimony, bismuth, cerium, magnesium and palladium; and selenides of lead, zinc, antimony and nickel.

A preferred method of forming noble metal nuclei is disclosed and claimed in copending application Ser. No. 649,201, filed Jan. 14, 1976, the disclosure of which is incorporated herein in its entirety.

The following nonlimiting example illustrates the preparation of a solution acid hydrolyzed cellulose acetate.

EXAMPLE 1

125 g. of cellulose hydroacetate (34.4% acetyl, about 2.5 D.S.) was added to 625 g. of acetic acid and 250 g. of $H_2O$. The temperature was raised to 40° C. with constant stirring, and after all the cellulose hydroacetate had dissolved to form a clear, viscous solution, a strong acid catalyst consisting of a mixture of 16.3 g. sulfuric acid and 12.5 g. acetic acid was added. The reaction mix was stirred constantly. The temperature was maintained constant at 40° C. by immersion of the reaction pot in a constant temperature bath.

The extent of the hydrolysis reaction was followed by the MEK tolerance test wherein 5.0 cc of the reaction mix is withdrawn and dissolved in 50 ml of 1:1 by volume of ethanol:water. This solution is titrated with methyl ethyl ketone to the to the first visible turbidity. The amount of methyl ethyl ketone required decreases as the acetyl content of the cellulose acetate decreases.

After the reaction had progressed to the desired extent, the reaction mix was removed from the pot and slowly diluted with methanol until precipitation occurred. The precipitate was then washed with four changes of methanol and then with two stabilizing washes of methanol containing 0.004% potassium acetate. The purpose of the potassium acetate is to neutralize traces of residual acid and thereby ensure a stable product. After rinsing and stabilizing, the products are dried.

The data from several runs are summarized in Table I.

TABLE I

| Run | MEK Value | % Acetyl | Hydrolysis Time |
|---|---|---|---|
| A | 57.0 | 26.8 | 20.3 hr. |
| B | 56.7 | 26.6 | 19.8 hr. |
| C | 47.7 | 26.5 | 25.8 hr. |
| D | 34.2 | 23.1 | 28.3 hr. |
| E | 29.0 | 22.9 | 30.2 hr. |
| F | 8.8 | 21.1 | 44.4 hr. |
| G | 8.5 | 21.2 | 43.0 hr. |

It will be noted that MEK value is a linear function of hydrolysis time.

EXAMPLE 2

Receiving layers within the scope of the present invention were prepared as follows:

Hydrolyzed cellulose acetates were prepared according to the procedures of Example 1 and diluted to a 3% solution with the following solvent mix:

| | |
|---|---|
| ethanol | 18.09 ml. |
| water | 47.57 ml. |
| tetrahydrofurfuryl alcohol | 11.67 ml. |
| β-hydroxyethyl acetate | 6.80 ml. |
| sec-butanol | 15.87 ml. |

As a control, cellulose hydroacetate, the starting material for the hydrolyzed cellulose acetate was dissolved in a solvent mix comprising:

| | |
|---|---|
| acetone | 23.1 ml. |
| ethyl acetate | 31.5 ml. |
| methanol | 31.5 ml. |
| water | 3.8 ml. |
| methyl cellosolve acetate | 10.0 ml. |

to a 3% solution.

The cellulose acetates were coated at a coating weight of 185 mg./ft$^2$ on a support comprising black pigmented polyester base carrying a 1:2 by weight $TiO_2$/acrylic latex binder (sold by Rhom & Haas Co., Philadelphia, Pa., under the trade name RHOPLEX AC 61) layer at 400 mg./ft$^2$ as a reflective layer, a layer of a 1:1 mixture by weight of cellulose diacetate and methyl vinyl ether/maleic anhydride copolymer (commercially available from General Aniline and Film under the trade name GANTREZ AN119) at a coverage of 300 mg./ft$^2$.

Silver precipitating nuclei were formed in the following manner:

The coated supports were dipped into an aqueous solution of 0.75% tin hydrosol prepared according to the procedure of Example 1 in application Ser. No. 649,202, filed Jan. 14, 1976, rinsed in distilled water, dipped in a $1\times10^{-3}$M $K_2PdCl_4$ solution and again rinsed with distilled water. Two different pH $K_2PdCl_4$ solutions were employed.

The thus formed image receiving layers were processed in conjunction with an exposed Type 87 negative and processing composition (Polaroid Corporation, Cambridge, Mass.). The Dmax and image rub resistance is set forth in Tables 2 and 3 below. Image rub resistance is a qualitative estimate of resistance of the wet image to removal by moderate finger pressure.

TABLE 2

| Cellulose Acetate MEK Value | pH of $K_2PdCl_4$ Solution | Image Rub Resistance(wet) | Dmax |
|---|---|---|---|
| Cellulose Hydro-acetate Control | 0.73 | very poor | 0.88 |
| 57 | 0.73 | very poor | 1.08 |
| 56.7 | 0.73 | very poor | 1.18 |
| 47.7 | 0.73 | very poor | 1.06 |
| 34.2 | 0.73 | poor | 1.28 |
| 29.0 | 0.73 | fair | 1.22 |
| 8.5 | 0.73 | good | 1.16 |

TABLE 3

| | | | |
|---|---|---|---|
| Cellulose Hydro-acetate Control | 1.98 | very poor | 1.42 |
| 57 | 1.98 | very poor | 1.00 |
| 56.7 | 1.98 | very poor | 1.00 |
| 47.7 | 1.98 | very poor | 1.02 |
| 34.2 | 1.98 | fair | 1.22 |
| 29.0 | 1.98 | good | 1.35 |
| 8.5 | 1.98 | good | 1.20 |

As the MEK value goes down (corresponding to lower acetyl content) the silver image is more deeply imbeded within the layer and more resistant to damage by abrasion.

The following examples illustrate the preparation of image-receiving elements within the scope of the present invention wherein silver precipitating nuclei are disposed in the hydrolyzed cellulose acetate prior to forming a layer.

EXAMPLE 3

A tin-palladium nuclei solution was prepared as follows:

| | |
|---|---|
| Part 1 | |
| Water | 300 cc. |
| Concentrated hydrochloric acid | 200 cc. |
| Part 2 | |
| $K_2PdCl_4$ | 2.6 g. |
| Water | 250 cc. |
| Part 3 | |
| Stannous Chloride | 2.88 g. |
| Part 1 | 200 cc. |
| Part 4 | |
| Stannous Chloride | 4.32 g. |
| Part 1 | 50 cc. |

At 25° C., Part 2 was added to Part 3 while stirring. Stirring was continued for 30 minutes, then Part 4 added with stirring and stirring continued for an additional 5 minutes.

The following hydrolyzed cellulose acetate solution was then prepared:

| | |
|---|---|
| ethanol | 54.3 ml |
| water | 142.7 ml |
| tetrahydrofurfuryl alcohol | 35.0 ml |
| β-hydroxyethyl acetate | 20.4 ml |
| sec butanol | 47.6 ml |
| hydrolyzed cellulose acetate (MEK 8.8) | 9.00 g |

39.6 cc. of the hydrolyzed cellulose acetate solution was mixed with 2.0 cc. of the nuclei dispersion and the mix coated on to the support described in Example 2 at a coverage of 0.28 mg./ft$^2$ of palladium and 98 mg./ft$^2$ hydrolyzed cellulose. The thus formed image-receiving element was exposed and processed as in Example 1 with a Polaroid Type 87 negative and processing composition. A well imbedded abrasion resistant image was attained having a Dmax of 1.41 and a Dmin of 0.

EXAMPLE 4

The following substantially fully hydrolyzed cellulose acetate solution was prepared:

| | |
|---|---|
| ethanol | 18.1 ml |
| water | 47.6 ml |
| tetrahydrofurfuryl alcohol | 11.7 ml |
| β-hydroxyethyl acetate | 6.8 ml |
| 2-butanol | 15.9 ml |
| hydrolyzed cellulose acetate (MEK 8.5) | 3.00 g |

The support described in Example 2 was coated with a mixture comprising 25 ml. of the hydrolyzed cellulose acetate solution, 0.58 ml. of 1.3% tin hydrosol prepared as in Example 2, and 25 ml. of the following solvent solution:

| | |
|---|---|
| ethanol | 18.1 ml |
| water | 47.6 ml |
| tetrahydrofurfuryl alcohol | 11.7 ml |
| β-hydroxyethyl acetate | 6.8 ml |
| 2-butanol | 15.9 ml |

to give coverage of 50 mg./ft$^2$ hydrolyzed cellulose acetate 0.5 mg./ft$^2$ of tin hydrosol. The coating was dried and then coated with a mixture comprising 25 ml. of $2\times10^{-3}$ M $K_2PdCl_4$ solution (pH 1.38 with hydrochloric acid) and 25 ml. of a solvent solution comprising

| | |
|---|---|
| water | 56.5 ml |
| β-hydroxyethyl acetate | 13.0 ml |
| 2-butanol | 30.4 ml |

to give a palladium nuclei coverage of 0.1 mg/ft$^2$. The image-receiving element was processed with an exposed Type 107C negative and processing composition as in Example 2. A well imbedded abrasion resistant image was obtained having a Dmax of 1.43 and a Dmin 0.03.

The photosensitive stratum may contain one or more of the silver halides, of which silver chloride, silver bromide and silver iodide are examples, dispersed in a suitable protective colloid material, for example, gelatin, agar, albumen, casein, collodion, a cellulosic such as carboxymethyl cellulose, a vinyl polymer such as polyvinyl alcohol. Examples of specific formulations of conventional emulsions suitable for such use are described in T. T. Baker, *Photographic Emulsion Technique,* American Photographic Publishing Company, Boston, 1948, Chapter IV.

Suitable silver halide developing agents include benzene derivatives having at least two hydroxyl and/or amino groups substituted in ortho or para position on the benzene nucleus, such as hydroquinone, amidol, metol, glycin, p-aminophenol and pyrogallol; and hydroxylamines, in particular, primary and secondary aliphatic and aromatic N-substituted or β-hydroxylamines which are soluble in aqueous alkali, including hydroxylamine, N-methyl hydroxylamine, N-ethyl hydroxylamine, and others described in U.S. Pat. No. 2,857,276 issued Oct. 21, 1958 to Edwin H. Land et al. and N-alkoxyalkyl-substituted hydroxylamines as described in U.S. Pat. No. 3,293,034, issued Dec. 20, 1966 to Milton Green et al. Suitable silver halide solvents include conventional fixing agents such as sodium thiosulfate, sodium thiocyanate, ammonium thiosulfate and others described in the aforementioned U.S. Pat. No. 2,543,181; and associations of cyclic imides and nitrogenous bases such as associations of barbiturates or uracils, and ammonia or amines, and other associations described in U.S. Pat. No. 2,857,274, issued Oct. 21, 1958 to Edwin H. Land et al.

It will be understood that transparent supports may be employed in lieu of paper or opaque plastic supports where it is desired to have transparencies which may be viewed by transmitted light or by projection. It is also within the scope of this invention to use a translucent support, e.g., a cellulose triacetate support which has been coated with a translucent layer of titanium dioxide. Use of a translucent support permits the transfer image to be viewed by reflected or transmitted light.

As is well known in the art, silver precipitants are present in very low quantities, e.g., about 1 to $25\times10^{-6}$ moles per square foot. Higher levels are usually less desirable as they may cause excessive silver deposition or undesirable background density in the highlight areas. Mixtures of silver precipitants may be used. In general, the reflection density to white light of the unprocessed but hydrolyzed image-receiving layer coated on baryta should be less than 0.05 as compared with the uncoated baryta paper. The image-receiving layer thus may be described as substantially colorless and substantially transparent insofar as the presence of the nuclei is concerned. In certain instances it may be desirable to incorporate very small quantities of a blue or purple dye into the cellulose acetate coating solution, e.g., 0.5 to 5 cc. of a 1 percent solution of the dye per liter of coating solution, to act as a yellow filter to neutralize any background color imparted by diffusion transfer processing. Examples of dyes which may be used for this purpose include methylene blue, Direct Blue 70, methyl violet, Benzoform Brilliant Blue, etc.

Additive color images may be formed by forming the silver transfer image in an image-receiving element formed in accordance with this invention, said image being in registered relationship with an additive color screen. In such embodiments, the additive color screen is preferably positioned between a transparent support and said silver-receptive stratum, exposure of the silver halide emulsion being effected through said screen.

It is also contemplated to utilize the techniques of this invention in high covering power transfer processes of the type disclosed in U.S. Pat. No. 2,861,885 issued Nov. 25, 1958 to Edwin H. Land, wherein the positive transfer image may be maintained in superposed relationship with the developed silver halide layer and viewed as a positive image.

It is also contemplated that the silver halide emulsion may be coated over the image-receptive stratum, the silver halide emulsion being removable after processing, as by provision of a suitable stripping layer or by employment of a silver halide emulsion which may be readily washed off after processing, e.g., a silver halide emulsion wherein the binder is cellulose acetate hydrogen phthalate. Alternatively, a pigmented layer, e.g., titanium dioxide in gelatin or a suitable plastic, may be positioned between the silver halide emulsion and the silver-receptive stratum coated on a transparent base, and the silver transfer image viewed through the transparent base against the pigmented layer, the pigmented layer masking out the image in the developed silver halide emulsion layer.

What is claimed is:

1. A method for forming an image-receiving element for use in a silver diffusion transfer process which comprises the steps of acid hydrolyzing a solution of cellulose ester, coating a support with said hydrolyzed cellulose ester and disposing silver precipitating nuclei in said hydrolyzed cellulose ester.

2. The method as defined in claim 1 wherein said nuclei are disposed in said solution prior to said coating.

3. The method as defined in claim 2 wherein said nuclei are disposed in said solution prior to hydrolyzing said cellulose ester.

4. The method as defined in claim 2 wherein said nuclei are disposed in said solution subsequent to hydrolyzing said cellulose ester.

5. The method as defined in claim 1 wherein said nuclei are disposed in said cellulose ester subsequent to coating on said layer.

6. The method as defined in claim 1 wherein said nuclei are formed in situ in said hydrolyzed cellulose ester.

7. The method as defined in claim 1 wherein said cellulose ester is cellulose hydroacetate.

8. The method as defined in claim 7 wherein said hydrolysis is carried out with sulfuric acid.

9. The method as defined in claim 1 wherein said hydrolyzed cellulose ester has an MEK value of less than 34.

10. The method as defined in claim 9 wherein said hydrolyzed cellulose ester has a MEK value of about 8.5.

11. The method as defined in claim 1 wherein said nuclei comprise noble metal nuclei.

12. The method as defined in claim 11 wherein said nuclei is palladium.

* * * * *